US011022921B2

(12) United States Patent
Maehata et al.

(10) Patent No.: US 11,022,921 B2
(45) Date of Patent: Jun. 1, 2021

(54) IMAGE FORMING APPARATUS

(71) Applicants: Yasuhiro Maehata, Tokyo (JP); Hiroaki Takagi, Kanagawa (JP); Kenji Tomita, Tokyo (JP)

(72) Inventors: Yasuhiro Maehata, Tokyo (JP); Hiroaki Takagi, Kanagawa (JP); Kenji Tomita, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/837,391

(22) Filed: Apr. 1, 2020

(65) Prior Publication Data

US 2020/0326648 A1 Oct. 15, 2020

(30) Foreign Application Priority Data

Apr. 10, 2019 (JP) ..... JP2019-074624
Dec. 9, 2019 (JP) ..... JP2019-222336

(51) Int. Cl.
*G03G 15/20* (2006.01)
*G03G 15/00* (2006.01)

(52) U.S. Cl.
CPC ..... *G03G 15/2053* (2013.01); *G03G 15/6529* (2013.01)

(58) Field of Classification Search
CPC ..... G03G 15/2053; G03G 15/6529; G03G 15/757; G03G 2221/1657
USPC ..... 399/167, 328, 320
See application file for complete search history.

(56) References Cited

U.S. PATENT DOCUMENTS 8,744,313 B2 * 6/2014 Miura ..... G03G 15/757 399/167
9,042,784 B2 * 5/2015 Matsuda ..... G03G 15/757 399/167
2017/0261887 A1 9/2017 Ishizuka et al.
2017/0269511 A1 9/2017 Tomita et al.
2017/0343937 A1 11/2017 Tomita et al.
2017/0357200 A1 12/2017 Takagi et al.
2017/0371291 A1 12/2017 Tomita et al.
(Continued)

FOREIGN PATENT DOCUMENTS

JP 2004-258353 9/2004
JP 2011-197027 A 10/2011
(Continued)

OTHER PUBLICATIONS

Extended European Search Report dated Aug. 18, 2020.
U.S. Appl. No. 16/594,772, filed Oct. 7, 2019, Shigeo Nanno, et al.

*Primary Examiner* — Hoan H Tran
(74) *Attorney, Agent, or Firm* — Harness, Dickey & Pierce. P.L.C.

(57) ABSTRACT

An image forming apparatus includes a driven unit and a drive transmitter. The drive transmitter includes a drive source, a drive gear, and a driven gear. The drive source is configured to drive the driven unit. The drive gear is configured to receive a driving force from the drive source. The driven gear is meshed with the drive gear. The drive transmitter is configured to transmit the driving force from the drive source to the driven unit. The drive gear or the driven gear is a crowned gear crowning-processed and the crowned gear has a crowning amount less than 50 μm.

19 Claims, 10 Drawing Sheets

(56) References Cited

U.S. PATENT DOCUMENTS

| | | | |
|---|---|---|---|
| 2018/0046128 | A1 | 2/2018 | Tomita et al. |
| 2018/0074455 | A1 | 3/2018 | Takagi |
| 2018/0181030 | A1 | 6/2018 | Tanaka et al. |
| 2018/0224779 | A1 | 8/2018 | Tomita et al. |
| 2018/0274649 | A1 | 9/2018 | Ohmi |
| 2019/0018353 | A1 | 1/2019 | Tomita et al. |
| 2019/0250540 | A1 | 8/2019 | Tomita |
| 2019/0286017 | A1 | 9/2019 | Nakamoto et al. |
| 2020/0004187 | A1 | 1/2020 | Takagi et al. |
| 2020/0063851 | A1 | 2/2020 | Nakamoto et al. |

FOREIGN PATENT DOCUMENTS

| | | | |
|---|---|---|---|
| JP | 2011-221164 | | 11/2011 |
| JP | 5705344 | B2 | 4/2015 |
| JP | 2015-169849 | A | 9/2015 |
| JP | 2018-155867 | | 10/2018 |

* cited by examiner

IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2019-074624, filed on Apr. 10, 2019, and 2019-222336, filed on Dec. 9, 2019, in the Japan Patent Office, the entire disclosure of each of which is hereby incorporated by reference herein.

BACKGROUND

Technical Field

This disclosure relates to an image forming apparatus.

Background Art

Various types of image forming apparatuses include a driven unit, a drive source to drive the driven unit, and a drive transmitter having a drive gear and a driven gear to transmit the driving force to the driven unit. The drive gear transmits a driving force from the drive source. The driven gear is meshed with the drive gear. One of the drive gear and the driven gear is a crowned gear by the process of gear crowning.

SUMMARY

At least one aspect of this disclosure provides an image forming apparatus including a drive unit and a drive transmitter. The drive transmitter includes a drive source, a drive gear, and a driven gear. The drive source is configured to drive the driven unit. The drive gear is configured to receive a driving force from the drive source. The driven gear is meshed with the drive gear. The drive transmitter is configured to transmit the driving force from the drive source to the driven unit. The drive gear or the driven gear is a crowned gear crowning-processed, and the crowned gear has a crowning amount less than 50 μm.

BRIEF DESCRIPTION OF THE SEVERAL VIEWS OF THE DRAWINGS

Exemplary embodiments of this disclosure will be described in detail based on the following figured, wherein.

Figure 1:
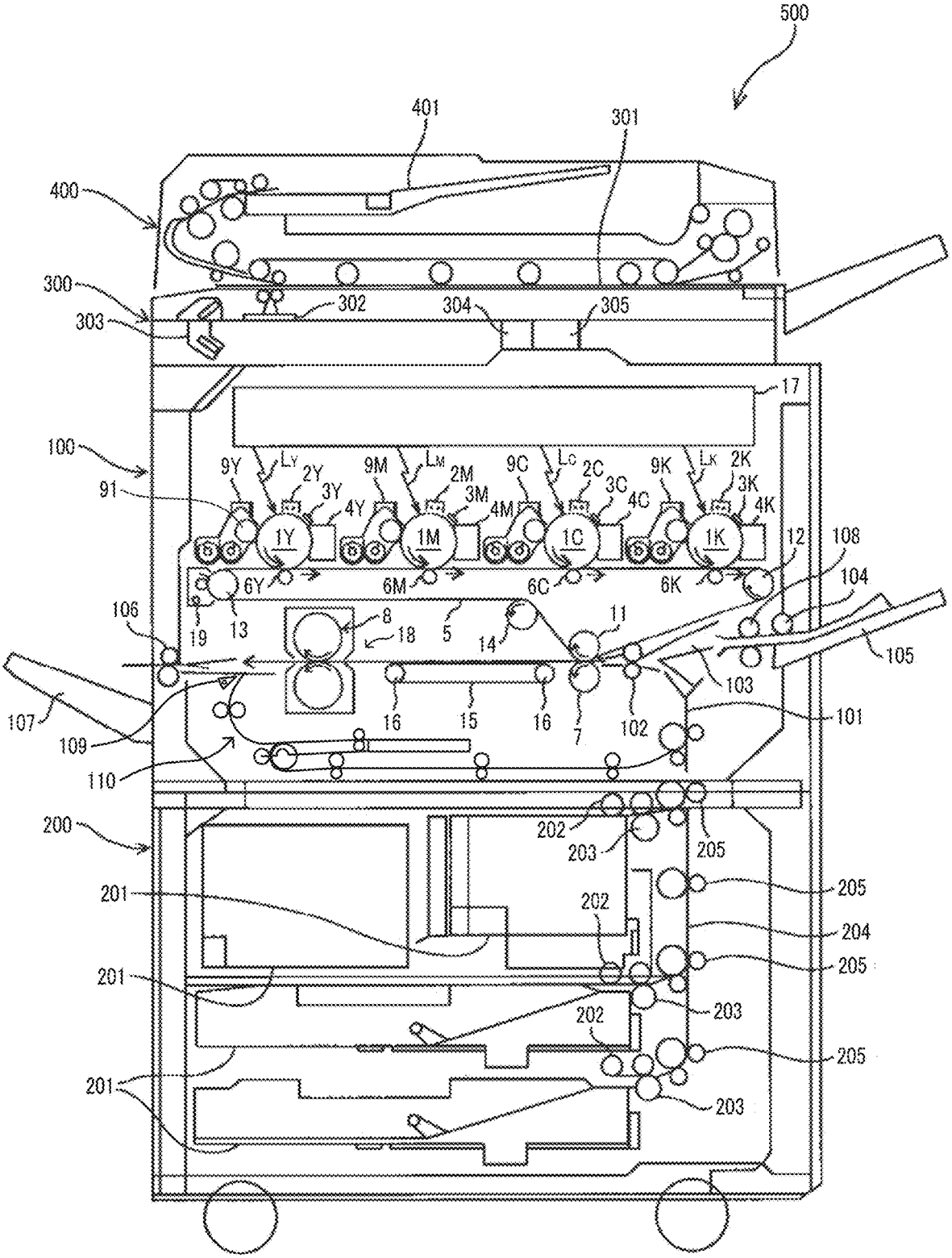
FIG. 1 is a diagram illustrating an overall schematic configuration of an image forming apparatus according to the present embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components)

having the same function or shape and redundant descriptions thereof are omitted below.

Descriptions are given below of an electrophotographic color copier that is an image forming apparatus according to an embodiment of the present disclosure with reference to the drawings.

First, a description is given of the detailed configuration of an image forming apparatus 500 according to the present embodiment of this disclosure.

FIG. 1 is a diagram illustrating an overall schematic configuration of the image forming apparatus 500 according to the present embodiment of this disclosure.

The image forming apparatus 500 according to the present embodiment is a tandem-type image forming apparatus and employs a dry two-component developing method using dry two-component developer. As illustrated in FIG. 1, the image forming apparatus 500 includes a housing 100, a sheet feeding table 200, a scanner 300, and an automatic document feeder 400. The housing 100 is installed on the sheet feeding table 200. The scanner 300 is attached to the housing 100. The automatic document feeder 400 is attached to the scanner 300.

The image forming apparatus 500 performs image formation by receiving image data that is image data read by the scanner 300 or by receiving print data sent from an external device such as a personal computer.

As illustrated in FIG. 1, the housing 100 contains four photoconductor drums 1Y, 1M, 1C, and 1K that are rotary bodies functioning as four cylindrical latent image bearers for each color of yellow (Y), magenta (M), cyan (C), and black (K). Hereinafter, the photoconductor drums 1Y, 1M, 1C, and 1K are occasionally referred to in a singular form without suffixes as the "photoconductor drum 1." Note that other devices and units, which have the structures basically identical to each other and provide different colors of toners to an image in a printing process, are also referred to in a singular form without suffixes. The photoconductor drum 1Y, 1M, 1C, and 1K are aligned in contact with an intermediate transfer belt 5 along a belt moving direction in which the intermediate transfer belt 5 moves. The intermediate transfer belt 5 is an endless belt supported by a plurality of rollers including a drive roller.

Electrophotographic process members or devices such as charging device 2 (i.e., charging devices 2Y, 2M, 2C, and 2K), a developing device 9 (i.e., developing devices 9Y, 9M, 9C, and 9K) for each color, a cleaning device 4 (i.e., cleaning devices 4Y, 4M, 4C, and 4K), and an electric discharging device 3 (i.e., electric discharging devices 3Y, 3M, 3C, and 3K) are disposed around the photosensitive drum 1 (i.e., the photoconductor drums 1Y, 1M, 1C, and 1K) in the order of image formation. An optical writing device 17 is disposed above the photoconductor drums 1Y, 1M, 1C, and 1K. Primary transfer rollers 6Y, 6M, 6C, and 6K, which are primary transfer units, are disposed at respective positions facing the photoconductor drums 1Y, 1M, 1C, and 1K, respectively, via the intermediate transfer belt 5. The primary transfer rollers 6Y, 6M, 6C, and 6K subsequently transfer respective single-color toner images formed on the surfaces of the photoconductor drums 1Y, 1M, 1C, and 1K onto the surface of the intermediate transfer belt 5, to form a composite toner image.

The intermediate transfer belt 5 is wound around stretching rollers 11, 12, and 13 and a tension roller 14. The stretching roller 12 functions as a drive roller that is rotated by the driving of a drive source. The intermediate transfer belt 5 rotates along with rotation of the stretching roller 12, together with the stretching rollers 11 and 13 and the tension roller 14. A belt cleaning device 19 is disposed at a position facing the stretching roller 13 via the intermediate transfer belt 5. The belt cleaning device 19 cleans the intermediate transfer belt 5 by removing residual toner remaining on the surface of the intermediate transfer belt 5 after secondary transfer in which the composite toner image formed on the surface of the intermediate transfer belt 5 is transferred onto a recording medium such as a sheet. The stretching roller 11 is a secondary transfer opposing roller that is disposed facing the secondary transfer roller 7 that functions as a secondary transfer unit. The stretching roller 11 (i.e., secondary transfer opposing roller) and the secondary transfer roller 7 form a secondary transfer nip region via the intermediate transfer belt 5.

A sheet conveying belt 15 is disposed downstream from the secondary transfer nip region in the sheet conveyance direction. The sheet conveying belt 15 is stretched by a pair of stretching rollers 16 and conveys the sheet having the toner image after secondary transfer, to a fixing device 18. The fixing device 18 includes a pair of fixing rollers 8 that forms a fixing nip region. In the fixing device 18, the image that is formed on but yet unfixed to the sheet is fixed to the sheet by application of heat and pressure in the fixing nip region by the pair of fixing rollers 8.

Next, a description is given of a copying operation performed by the image forming apparatus 500 according to the present embodiment.

In a case in which the image forming apparatus 500 according to the present embodiment of this disclosure form a full-color image, an original document is set on a document table 401 of the automatic document feeder 400. Note that the automatic document feeder 400 is hereinafter referred to as the ADF 400. Alternatively, the ADF 400 is opened to set the original document on an exposure glass 301 of the scanner 300, and then is closed to press the original document against the exposure glass 301. Thereafter, as a start button is pressed by a user, when the original document is set on the document table 401 of the ADF 400, the original document is conveyed to the exposure glass 301 of the scanner 300. Then, the scanner 300 is driven so that a first moving body 302 and a second moving body 303 start travelling. Consequently, light emitted from the first moving body 302 reflects on the original document placed on the exposure glass 301, and then reflects on a mirror (or mirrors) of the second moving body 303. Then, the light is guided to a reading sensor 305 through an image forming lens 304. Accordingly, the scanner 300 reads image data of the original document.

As a user presses the start button of the image forming apparatus 500, a motor is driven to rotate the stretching roller 12 that functions as a drive roller, thereby rotating the intermediate transfer belt 5. At the same time, the photoconductor drum 1 (i.e., the photoconductor drums 1Y, 1M, 1C, and 1K) is uniformly charged by the charging device 2 (i.e., the charging devices 2Y, 2M, 2C, and 2K) while a photoconductor drive device drives to rotate the photoconductor drum 1 (i.e., the photoconductor drums 1Y, 1M, 1C, and 1K) in a direction indicated by arrow in FIG. 1. A detailed description of the photoconductor drive device is given below. Thereafter, the optical writing device 17 emits a light beam L (i.e., light beams $L_Y$, $L_M$, $L_C$, and $L_K$) to form a single-color electrostatic latent image on the surface of the photoconductor drum 1. The single-color electrostatic latent image is developed by the developing device 9 (i.e., the developing devices 9Y, 9M, 9C, and 9K) with toner of the corresponding color in the developer. In a developing process, a given amount of developing bias is applied to between a developing roller 91 and the photoconductor drum 1, so that the toner supplied on the developing roller 91 is electrostatically attracted to the electrostatic latent image formed on the surface of the photoconductor drum 1 in a given clearance (i.e., development gap) formed between the developing roller 91 and the photoconductor drum 1.

The toner image thus developed is conveyed to the primary transfer position at which the photoconductor drum 1 and the intermediate transfer belt 5 contact along with rotations of the photoconductor drum 1. The primary transfer roller 6 applies a given bias voltage to a back face of the intermediate transfer belt 5 at this primary transfer position. Then, the toner image formed on the photoconductor drum 1 is drawn toward the intermediate transfer belt 5 by the primary transfer electric field generated by application of the given bias voltage, so that the toner image is transferred onto the intermediate transfer belt 5 as primary transfer. In the similar manner as described above, the respective single-color toner images, which are yellow, magenta, cyan, and black toner images, are sequentially transferred in layers onto the surface of the intermediate transfer belt 5 as primary transfer. It is to be noted that, after secondary transfer, residual toner remaining on the surface of the intermediate transfer belt 5 is removed by the belt cleaning device 19.

Further, as the start button is pressed by a user, a sheet feeding roller 202 of the sheet feeding table 200 according to the size of a sheet selected by the user starts rotating to feed a sheet from a selected one of sheet feed trays 201. When a plurality of sheets is fed from the selected sheet feed tray 201, the plurality of sheets is separated one by one by each pair of sheet separation rollers 203. After being conveyed to a sheet conveyance passage 204, the separated sheet is conveyed by pairs of sheet conveying rollers 205 to a sheet conveyance passage 101 in the housing 100 of the image forming apparatus 500. The sheet thus conveyed is stopped when the sheet comes to contact with a pair of registration rollers 102. It is to be noted that, when feeding a sheet that is not set on any of the sheet feed trays 201 but is set on a bypass sheet tray 105, the sheet is fed by a sheet feeding roller 104, separated one by one by a sheet separating roller 108, and conveyed to the housing 100 through a bypass sheet conveyance passage 103. Then, the sheet from the bypass sheet tray 105 is stopped when the sheet comes to contact with the pair of registration rollers 102.

After four single-color toner images are transferred and overlaid onto the surface of the intermediate transfer belt 5 to form a composite toner image, the composite toner image is conveyed along with rotations of the intermediate transfer belt 5, to the secondary transfer position at which the intermediate transfer belt 5 comes to face the secondary transfer roller 7. Further, the pair of registration rollers 102 starts rotating to convey the sheet to the secondary transfer position, in synchronization with timing at which the composite toner image formed as described above on the intermediate transfer belt 5 is conveyed to the secondary transfer position. At the secondary transfer position, the secondary transfer roller 7 applies a given bias voltage to the back face of the sheet. With the bias voltage generated in the secondary transfer electric field by the application of the bias voltage and the contact pressure at the secondary transfer position, the composite toner image formed on the intermediate transfer belt 5 is collectively transferred onto the sheet as secondary transfer. Thereafter, the sheet having the composite toner image after secondary transfer is conveyed to the fixing device 18 along with movement of the sheet conveying belt 15, so that the pair of fixing rollers 8 provided in the fixing device 18 performs a fixing operation to the sheet. Then, the sheet to which the composite toner image has been fixed during the fixing operation is conveyed by a pair of sheet ejecting rollers 106 onto a sheet ejection tray 107 provided outside the housing 100 of the image forming apparatus 500. The ejected sheet is stacked on the sheet ejection tray 107. Alternatively, the direction of conveyance of the sheet is switched by a switching claw 109 so that the sheet enters a sheet reversing device 110. In the sheet reversing device 110, the sheet is reversed and conveyed to the transfer position again. After a toner image is formed on the back face of the sheet at the transfer position, the sheet having toner images on both faces is ejected by the pair of sheet ejecting rollers 106 onto the sheet ejection tray 107.

In the present embodiment, the photoconductor drum 1 and the image forming units, such as the developing device 9, disposed around the photoconductor drum 1 are composed in a process cartridge of each color. The process cartridge is detachably attached to the housing 100 of the image forming apparatus 500. Specifically, the process cartridge of each color integrally supports the photoconductor drum 1, the charging device 2, the developing device 9, the cleaning device 4, and the electric discharging device 3. Note that the process cartridge may support at least the photoconductor drum 1 and the developing device 9.

Next, a description is given of an example of a drive device included in the image forming apparatus 500.

Figure 2:
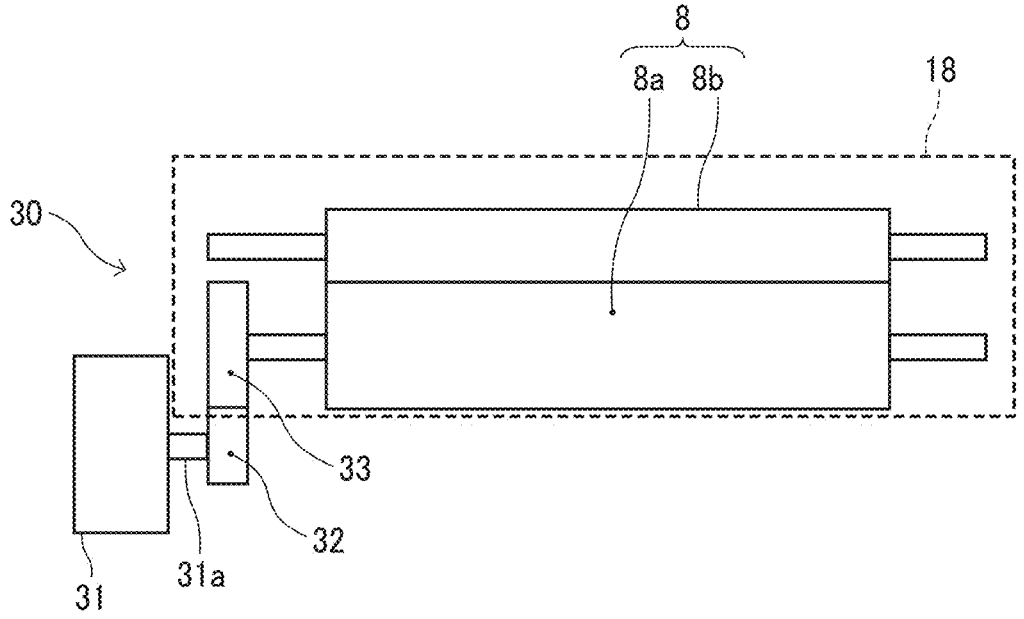
FIG. 2 is a diagram illustrating a schematic configuration of a drive device included in the image forming apparatus of FIG. 1.

FIG. 2 is a diagram illustrating a schematic configuration of a drive device 30 included in the image forming apparatus 500 of FIG. 1.

The drive device 30 drives the pair of fixing rollers 8 of the fixing device 18 as a driven unit. The drive device 30 has a drive motor 31 as a drive source. The drive motor 31 has a motor shaft 31*a* (as a drive shaft) made of metal. Directly on the motor shaft 31*a*, the teeth of a drive gear 32 made of metal are formed. A driven gear 33 made of resin meshes with the drive gear 32 and is mounted on the edge of a roller shaft of a fixing roller (drive roller) 8*a* of the pair of fixing rollers 8. The pair of fixing rollers 8 includes the fixing roller (drive roller) 8*a* and a pressure roller (driven roller) 8*b*. The drive device 30 includes a gear train including the drive gear 32 and a driven gear 33 and functions as a drive transmitter.

The drive gear 32 is a normal gear with the crowning amount of 0 μm and having the tooth trace parallel to the axial direction of the drive gear 32. On the other hand, the driven gear 33 is a crowned gear crowning-processed and has the crowning amount less than 50 μm. To be more specific, the crowned gear in the embodiments of this disclosure is a gear with crowned teeth having surfaces outwardly curved in a convex shape in the lengthwise direction of the teeth of the gear. In the present embodiment, the driven gear 33 is a crowned gear. However, the drive gear 32 may be a crowned gear having the crowning amount less than 50 μm.

Figure 3:
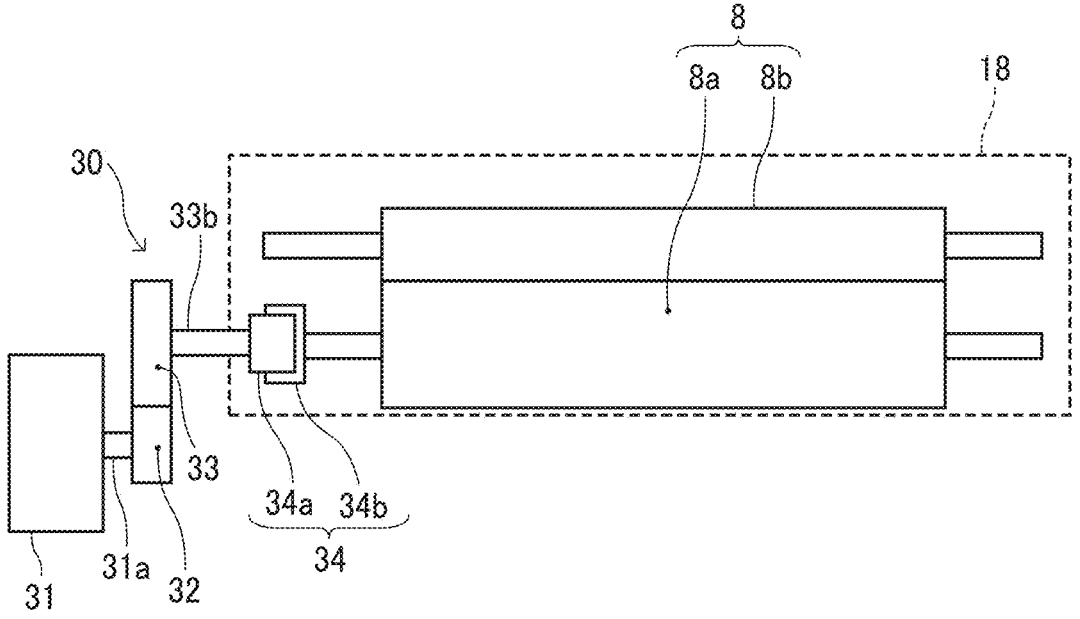
FIG. 3 is a diagram illustrating a variation of the drive device of FIG. 2.

FIG. 3 is a diagram illustrating a variation of the drive device 30.

The drive device 30 of the variation illustrated in FIG. 3 has a connecting joint 34 so that the fixing device 18 is detachably attached with respect to the housing 100 of the image forming apparatus 500.

The fixing device 18 applies heat and pressure to the sheet passing between the rollers of the pair of fixing rollers 8 to fix the four-color toner image that is transferred onto the surface of the sheet. As described above, in order to apply a given pressure to the sheet, one roller of the pair of fixing rollers 8 is pressed against the other roller of the pair of fixing rollers 8 with pressing force that is greater than the rollers of the other pairs of sheet conveying rollers. With this configuration, the fixing device 18 has a heavy torque load among the units in the image forming apparatus 500. Therefore, the load torque applied to the meshing portion of the drive gear 32 and the driven gear 33 is high, and the vibration at the time of gear meshing increases. As a result, the noise of the fixing device 18 may increase.

Further, in the drive device 30 illustrated in FIG. 3, a driven side coupling 34*b* is provided in the fixing device 18 and a drive side coupling 34*a* is mounted on the edge of a gear shaft 33*b* of the driven gear 33. In a case in which the fixing device 18 is detachably attached to the housing 100 as illustrated in FIG. 3, when coupling the driven side coupling 34*b* to the drive side coupling 34*a*, the gear shaft 33*b* tilts to easily cause misalignment between the drive gear 32 and the driven gear 33. Due to occurrence of such misalignment, vibration at the time of gear meshing increases, and therefore the noise of the fixing device 18 is likely to increase.

Note that misalignment occurs between the drive gear 32 and the driven gear 33 even in the configuration illustrated in FIG. 2, due to manufacturing error, assembly error, or both. For example, an assembly error of the drive motor 31 to the motor mounting face of the housing 100 causes the motor shaft 31*a* to tilt with respect to the motor mounting face of the housing 100, which is referred to as the tilt of the shaft. Due to the tilt of the motor shaft 31*a*, misalignment occurs between the drive gear 32 and the driven gear 33.

Figure 4A:
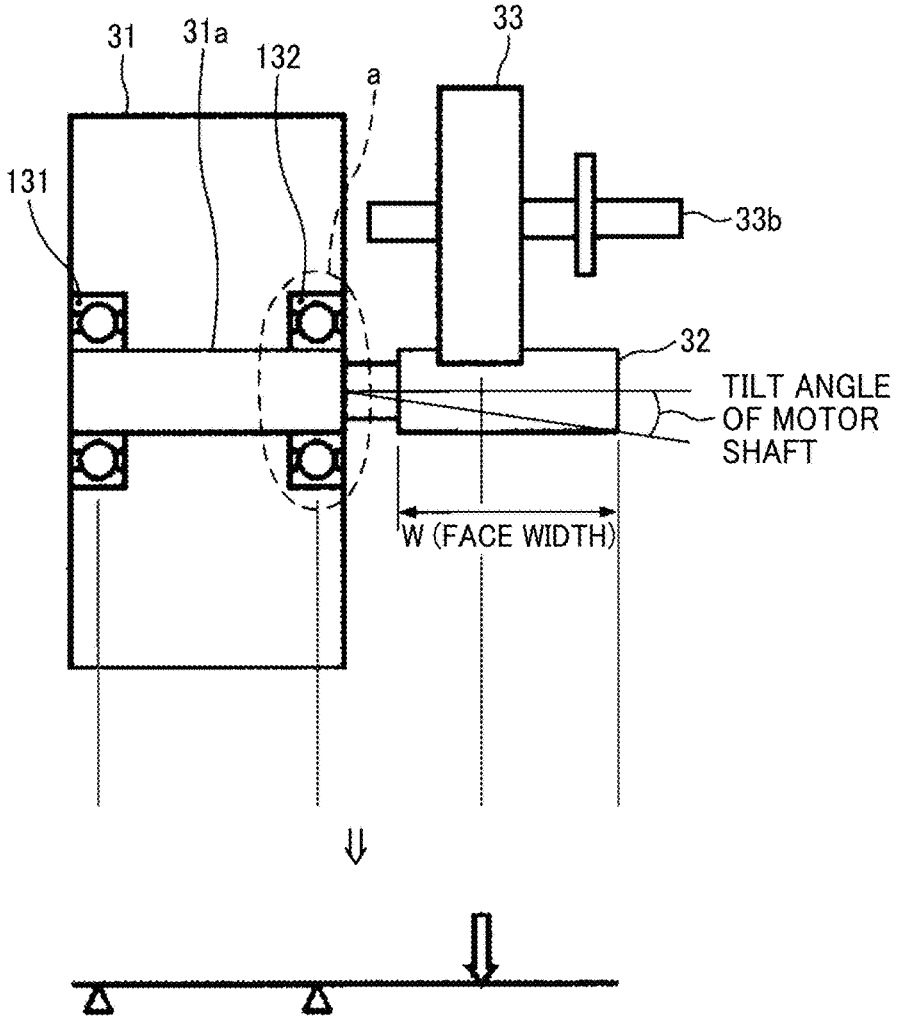
FIG. 4A is a diagram illustrating a schematic configuration of the drive device of FIG. 2, including a support mechanism of a motor shaft.
Figure 4B:
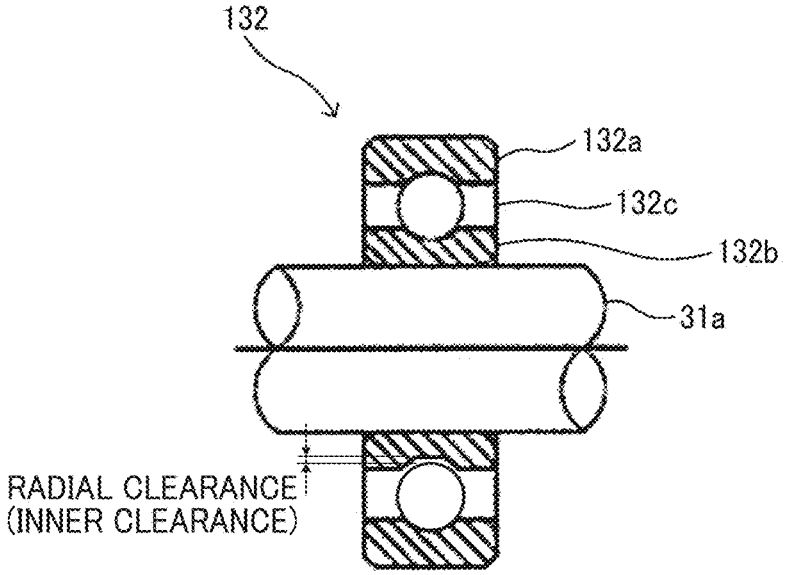
FIG. 4B is an enlarged view illustrating an area "a" encircled by a broken line in FIG. 4A.

FIGS. 4A and 4B are diagrams for explaining a support of the motor shaft 31*a*. FIG. 4A is a diagram illustrating a schematic configuration of the drive device 30 of FIG. 2, including a support mechanism of the motor shaft 31*a*. FIG. 4B is an enlarged view illustrating an area "a" encircled by a broken line in FIG. 4A.

The drive motor 31 is a brushless motor, in which two ball bearings 131 and 132 are provided to receive the motor shaft 31*a*. As described above, the motor shaft 31*a* has one end supported by the two ball bearings 131 and 132 and the opposed end having the drive gear 32. The opposed end functions as a free end of the motor shaft 31*a*. Therefore, the motor shaft 31*a* is easily warped by the force applied to the tooth surface of the drive gear 32, and therefore the tilt of motor shaft 31*a* occurs easily.

Further, as illustrated in FIG. 4B, the brushless motor may have backlash between an inner ring 132*b* of the ball bearing 132 (for example, the ball bearing 132 as illustrated in FIG. 4B) and the motor shaft 31*a*, between an outer ring 132*a* of the ball bearing 132 and the housing 100, between the outer ring 132*a* of the ball bearing 132 and a ball 132*c* of the ball bearing 132, and between the inner ring 132*b* of the ball bearing 132 and the ball 132*c* of the ball bearing 132. Among the above-described backlash, the backlash between the inner ring 132*b* of the ball bearing 132 and the motor shaft 31*a* and the backlash between the outer ring 132*a* of the ball bearing 132 and the housing 100 are eliminated by pressing the ball bearing 132 between the motor shaft 31*a* and the housing 100. However, a radial clearance, which is an inner clearance or the backlash between the outer ring 132*a* of the ball bearing 132 and the ball 132*c* of the ball bearing 132 or the backlash between the inner ring 132*b* of the ball bearing 132 and the ball 132*c* of the ball bearing 132, is not eliminated and has the backlash of 5 μm to 10 μm. Due to the above-described backlash, the tilt of the motor shaft 31*a* increases.

As described above, it is likely that the positional deviation of the motor shaft 31*a* is ±0.35 mm at the maximum and the tilt angle of the motor shaft 31*a* is ±0.7 degrees at the maximum due to accumulation of the tilt of the motor shaft 31*a* caused by the drive motor 31 alone, the tilt of the motor shaft 31*a* caused by the assembly error when attaching the drive motor 31 to the motor mounting face of the housing 100, and the tilt of the motor shaft 31*a* caused by force applied to the tooth face of the drive gear 32 at the start of driving after assembly.

Note that the above-described positional deviation is obtained by the following equation:

Positional Deviation=Length (Face Width) of Drive Gear 32*tan(Tilt Angle of Motor Shaft 31*a*).

As described above, it is likely that, even in the configuration illustrated in FIG. 2, misalignment occurs between the drive gear 32 and the driven gear 33 due to the tilt of the motor shaft 31*a* described above, so that vibration at the time of gear meshing of the drive gear 32 and the driven gear 33, and therefore the noise of the image forming apparatus 500 increases.

It is preferable that the diameter of the drive gear 32 is relatively small so as to reduce the size of the image forming apparatus 500 and the drive gear 32 obtains a large reduction ratio. Further, the drive gear 32 is made of metal from the point of view of the reduction in durability of the drive gear 32 caused by the reduction of the size. Further, it is preferable that the drive gear 32 is formed directly on the motor shaft 31*a*. Accordingly, while reducing the size of the image forming apparatus 500, the metallic drive gear 32 preferably obtains a large reduction ratio and achieves high durability. However, the metal gear is harder than the resin gear. Therefore, unlike the resin gear, the metal gear is not capable of sufficiently absorbing the load with elastic deformation. As a result, the vibration of the gears at the meshing increases, and therefore the noise may increase.

Further, in a case in which the vibration at the gear meshing between the drive gear 32 and the driven gear 33 is transmitted to, for example, the photoconductor drum 1 to vibrate the photoconductor drum 1 vibrates in a rotational direction in which the photoconductor drum 1 rotates, an abnormal image such as an image with banding may be generated.

As an example, a known image forming apparatus includes a driven gear to be an asymmetric crowned gear that is a crowned gear with asymmetric crowned teeth, in which the position of the maximum tooth thickness is shifted from the center in a tooth trace direction. The crowning amount of the asymmetric crowned gear of the known image forming apparatus is 70 μm.

However, the noise of the device is increased.

In order to restrain such vibration between the drive gear 32 and the driven gear 33 at the gear meshing, the precision of gears has been enhanced and resin gears have been employed. However, in recent years, demands for lower noise of gears at the gear meshing and higher quality of gears have risen. In order to achieve the above-described demands, a crowned gear is employed as the driven gear 33 of the present embodiment. A crowned gear is employed as the driven gear 33 to restrain vibration of gears at the gear meshing that is likely to occur at occurrence of misalignment. In addition, by performing an appropriate crowning to set the crowning amount less than 50 μm to the driven gear 33, an increase in noise at the gear mesh frequency is restrained, and therefore the noise of the gear meshing is reduced.

Figure 5A:
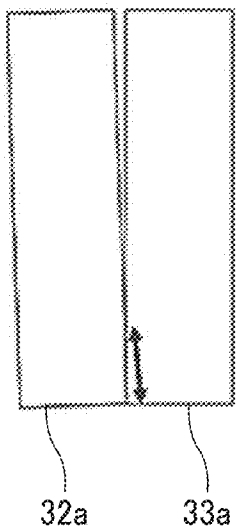
FIGS. 5A, 5B, and 5C are views of meshing of a drive gear and a driven gear on the occurrence of misalignment.
Figure 5B:
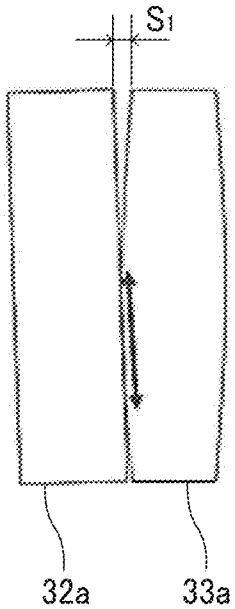
Figure 5C:
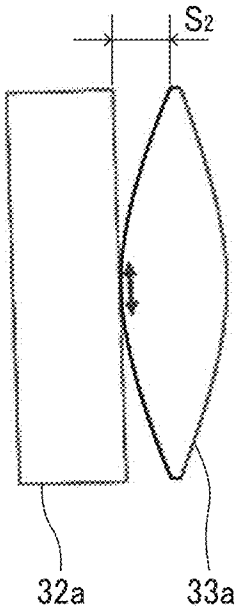

FIGS. 5A, 5B, and 5C are views of gear meshing of the drive gear 32 and the driven gear 33 on the occurrence of misalignment. To be more specific, FIG. 5A is a diagram illustrating a case in which the drive gear 32 and the driven gear 33 are normal gears having the crowning amount of 0

μm, FIG. 5B is a diagram illustrating a case in which the driven gear 33 with an appropriate crowning amount, and FIG. 5C is a diagram illustrating a case in which the driven gear 33 with an excessive crowning amount.

There are cases that misalignment occurs since the gear shaft of the driven gear 33 is tilted or the driven gear 33 is tilted with respect to the gear shaft of the driven gear 33 due to the backlash between the driven gear 33 and the gear shaft of the driven gear 33. In such cases, when the drive gear 32 and the driven gear 33 are normal gears, as illustrated in FIG. 5A, the drive gear 32 and the driven gear 33 are not meshed in the whole face width but the lower part (in FIG. 5A) of a tooth 32*a* of the normal drive gear 32 and the lower part (in FIG. 5A) of a tooth 33*a* of the normal driven gear 33 are only meshed. This state is a partial contact state in which the driving force of a gear is received in a part of the face width of another gear. When the driving force is transmitted in such a partial contact state, the drive transmission is unstable to result in an increase in vibration and rotational unevenness. As a result, noise at the gear meshing increases and the image quality deteriorates.

On the other hand, in a case in which the driven gear 33 has an excessive crowning amount S2 of 50 μm or greater, as illustrated in FIG. 5C, even when the misalignment occurs, the position of tooth contact is located in the substantially center in the tooth trace direction. This configuration restrains twist of a tooth or teeth, twist of a gear in the rotational direction, or both caused by application of the load at one end side of a tooth or teeth. As a result, vibration of the whole gear is reduced. However, the face width at which the tooth 32*a* of the drive gear 32 and the tooth 33*a* of the driven gear 33 mesh with each other is significantly narrow, and the load concentrates on a significantly small area between the tooth 32*a* of the drive gear 32 and the tooth 33*a* of the driven gear 33. Due to the above-described load concentration, noise increases at the gear mesh frequency increases. Details of the increase in noise due to load concentration are described below.

By contrast, as illustrated in FIG. 5B, the driven gear 33 has the appropriate crowning amount S1, which is, for example, the crowning amount S1 less than 50 μm, the gear meshing portion (the tooth contact portion) between the tooth 32*a* of the drive gear 32 and the tooth 33*a* of the driven gear 33 is located closer to the center in the face width when compared with the gear meshing portion between the tooth of the normal drive gear and the tooth of the normal driven gear with the crowning amount of 0 μm. Further, the greater face width in which the tooth 32*a* of the drive gear 32 and the tooth 33*a* of the driven gear 33 mesh with each other is achieved when compared with the configuration illustrated in FIG. 5C, with the excessive crowning amount S2 of the driven gear 33. As a result, vibration generated at the gear meshing of the gears and rotation unevenness of the gears are restrained, and therefore an increase in noise and deterioration in image quality are restrained.

Further, among the plurality of gears in the image forming apparatus 500, it is preferable that a gear mounted on a motor shaft or a gear meshing with the gear on the motor shaft is a crowned gear. When the load is applied, the load is removed toward an upstream side in a drive transmission direction in which the driving force is transmitted, due to backlash, on the downstream side, from the gear meshing portion of the gear on the motor shaft, in the drive transmission direction. However, the gear mounted on the motor shaft is a gear that directly receives the driving force from the drive motor, that is, the highest load is applied to the gear meshing portion of the gear mounted on the motor shaft and the gear meshing with the gear mounted on the motor shaft. Therefore, by employing a crowned gear as a gear mounted on the motor shaft or a gear meshing with the gear mounted on the motor shaft and by providing the crowning amount less than 50 μm to the crowned gear, noise of the gear meshing is effectively restrained when a misalignment of gears occurs.

Verification Test 1.

A gear meshing verification test, Verification Test 1, was conducted with the drive device 30 illustrated in FIG. 3 to evaluate the gear meshing on cases in which the driven gear 33 is a normal gear (with the crowning amount=0 μm), the driven gear 33 is a crowned gear with the crowning amount of 20 μm, and the driven gear 33 is a crowned gear with the crowning amount of 50 μm.

The driving conditions for the evaluation of the gear meshing are as follows:

Load of Driven Unit (Fixing Device): 2.0 [N·m];
Rotation Speed of Drive Motor: 2000 [rpm];
Deceleration of Driving: 15;
Drive Gear 32: Metal Gear (Normal Gear);
Driven Gear 33: Resin Gear (Crowned Gear); and
Gear Meshing Frequency of Drive Gear 32 and Driven Gear 33: 600 Hz to 700 Hz.

Under the above-described driving conditions, the drive device 30 was driven to measure vibration of the drive gear 32 and the driven gear 33.

Figure 6:
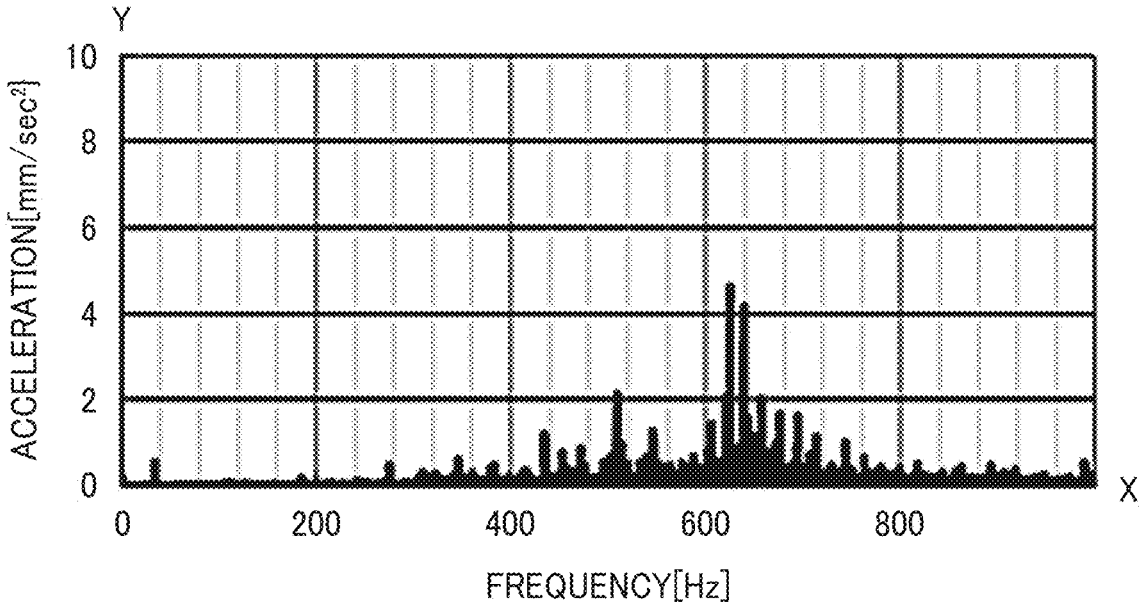
FIG. 6 is a graph of vibration data in a case in which the driven gear has the crowning amount of 0 μm.
Figure 7:
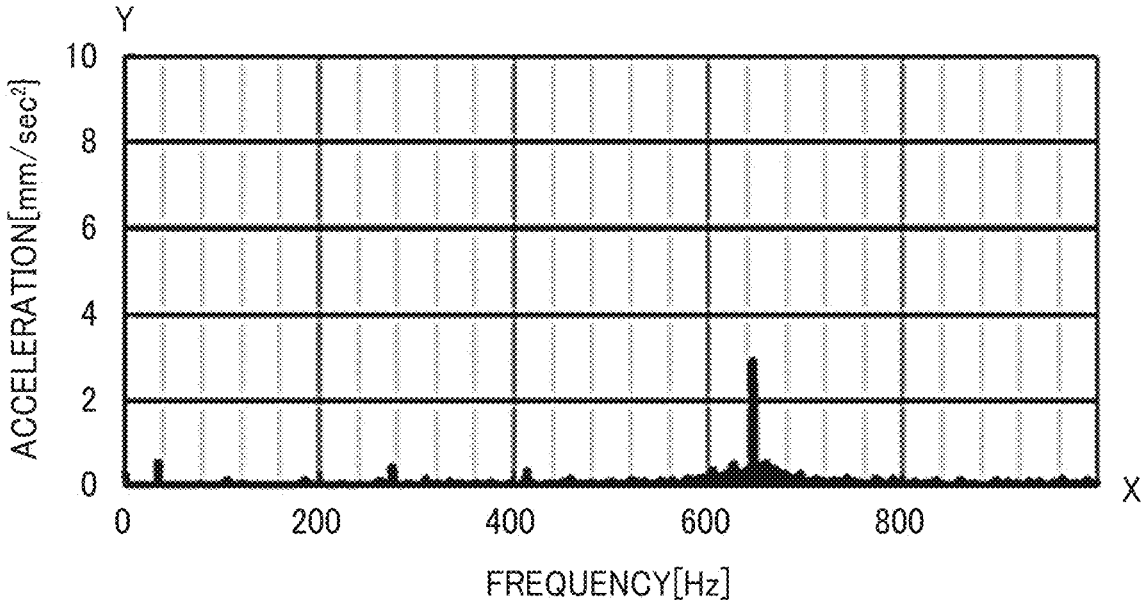
FIG. 7 is a graph of vibration data in a case in which the driven gear is a crowned gear having the crowning amount of 20 μm
Figure 8:
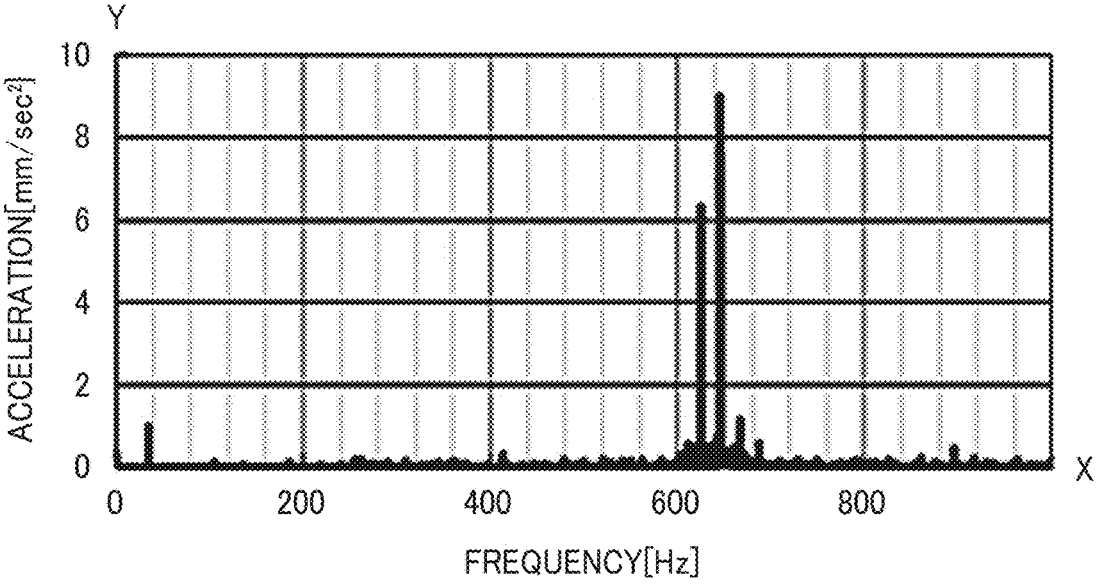
FIG. 8 is a graph of vibration data in a case in which the driven gear is a crowned gear having the crowning amount of 50 μm.

FIGS. 6 to 8 are graphs rendering the results of the tests. Specifically, FIG. 6 is a graph of vibration data in a case in which the driven gear 33 is a normal gear (having the crowning amount of 0 μm). FIG. 7 is a graph of vibration data in a case in which the driven gear 33 is a crowned gear having the crowning amount of 20 μm. FIG. 8 is a graph of vibration data in a case in which the driven gear 33 is a crowned gear having the crowning amount of 50 μm. In FIGS. 6 to 8, an X axis (horizontal axis) represents frequency and a Y axis (vertical axis) represents acceleration (vibration).

In a case in which the driven gear 33 is a normal gear (having the crowning amount of 0 μm as illustrated in FIG. 6, the load applied to the tooth concentrates on the end portion of the driven gear 33 since the driven gear 33 meshes with the drive gear 32 at the end portion, as illustrated in FIG. 5A. Therefore, vibrations at various frequencies were observed due to vibrations, such as the twist of the tooth (teeth) in the rotational direction of the driven gear 33 and the twist of the driven gear 33 in the rotational direction of the driven gear 33.

Further, in a case in which the driven gear 33 is a crowned gear having the crowning amount of 50 μm, the tooth contact position of the driven gear 33 with the drive gear 32 is located in the substantially center in the face width direction. Therefore, neither tooth nor gear is twisted in the rotational direction of the driven gear 33. Accordingly, as illustrated in FIG. 8, vibrations of frequencies other than the gear meshing frequency (in a range of 600 Hz to 700 Hz) are sufficiently restrained. However, as illustrated in FIG. 5C, since the tooth contact width of the driven gear 33 is relatively narrow and the driving force is transmitted locally, the load concentrates on the center of the tooth, and therefore the vibration caused by the gear meshing frequency increased.

By contrast, in a case in which the driven gear 33 is a crowned gear having the crowning amount of 20 μm, the tooth contact position of the driven gear 33 is located in the substantially center in the face width direction, as illustrated in FIG. 5B. Therefore, the degree of twist of tooth and gear is restrained in the rotational direction of the driven gear 33 and, as illustrated in FIG. 7, vibrations of frequencies other than the gear meshing frequency (in the range of 600 Hz to 700 Hz) are sufficiently restrained. Further, as illustrated in FIG. 5B, with the appropriate tooth contact width, vibration of the gear mesh frequency was also restrained.

The sound pressure level when the driven gear 33 is a normal gear (having the crowning amount of 0 μm) is 60 [dB], which is the same as the sound pressure level when the driven gear 33 is a crowned gear having the crowning amount of 50 μm. On the other hand, the sound pressure level when the driven gear 33 is a crowned gear having the crowning amount of 20 μm is reduced to 59 [dB]. When compared with the sound pressure level of 60 [dB], the crowned gear having the crowning amount of 20 μm has reduced the sound energy amount by 30%. Accordingly, by employing the crowned gear having the crowning amount of 20 μm as the driven gear 33, the noise of the image forming apparatus 500 is greatly reduced.

Actually, in addition to the above-described tests with the driven gear 33, various crowned gears having different crowning amounts were evaluated. Through the tests, it has been proved that, if the driven gear 33 has at least a small crowning amount, in other words, if the driven gear 33 is a crowned gear, vibration of the driven gear 33 is reduced when compared with the driven gear 33 being a normal gear (with the crowning amount of 0 μm), thereby reducing noise of the image forming apparatus 500 or adverse effect on the image. From the above-described results, the driven gear 33 is a crowned gear having the crowning amount less than 50 μm. By so doing, when compared with the driven gear 33 being a normal gear (with the crowning amount of 0 μm), the driven gear 33 having the crowning amount less than 50 μm reduces the noise.

Verification Test 2.

In Verification Test 2, the tilt angle of the motor shaft 31*a* is changed to check the relation of the crowning amount of the driven roller 33 and the rotational unevenness of the driven roller 33.

Figure 9:
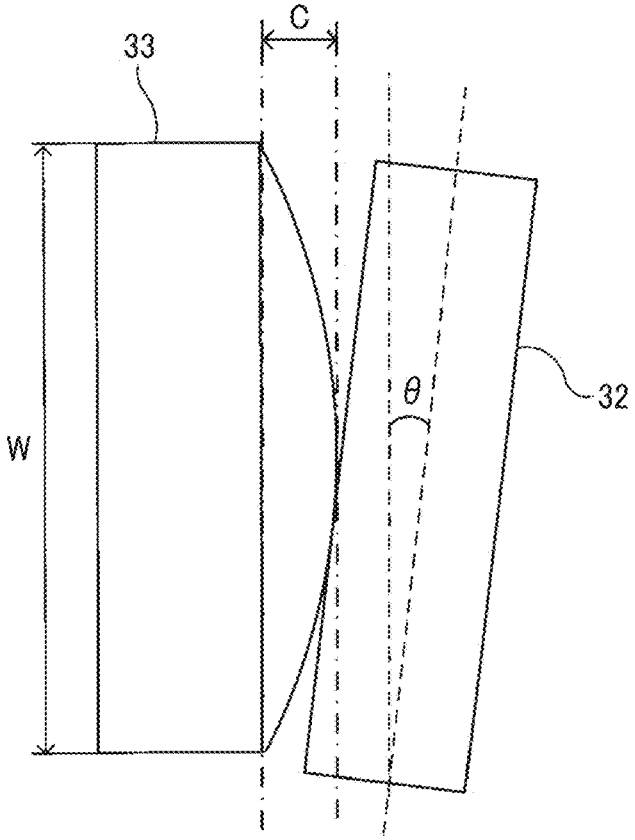
FIG. 9 is a diagram for explaining specifications of a drive gear and a driven gear in Verification Test 2.
Figure 10:
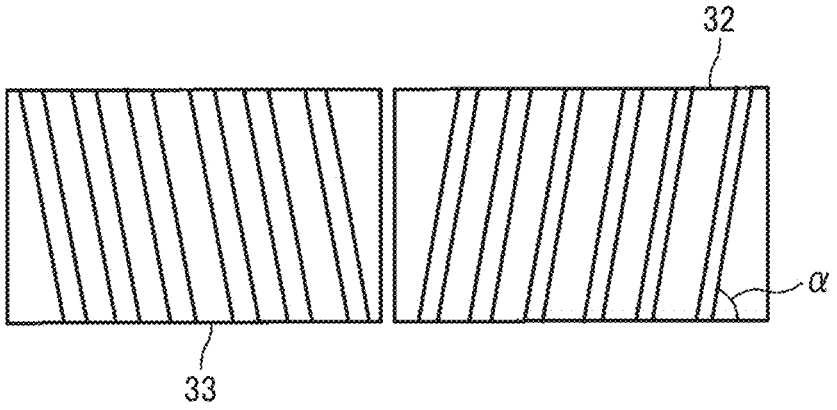
FIG. 10 is a diagram illustrating a helical gear.

As illustrated in FIG. 9, Verification Test 2 was conducted with a normal gear (with the crowning amount of 0 μm) as the drive gear 32 and six (6) different crowned gears having different crowning amounts C as the driven gear 33. The drive gear 32 and the driven gear 33 have the face width W of 10 mm. The drive gear 32 and the driven gear 33 are helical gears having a helix angle of 12 degrees. Note that the helix angle α is an angle of inclination of the helical tooth with respect to the axial direction of the gears, as illustrated in FIG. 10. The gear meshing frequency between the drive gear 32 and the driven gear 33 is 600 Hz to 700 Hz.

Further, as illustrated in FIG. 9, the drive motor 31 is tilted to adjust a tilt angle θ of the motor shaft 31*a*. The gear meshing position of the helical tooth changes from one end side to the opposed end side in the axial direction of a gear. A shaft tilt direction in which the shaft is tilted to cause a partial contact of gears on a first meshing side of a helical tooth is indicated as a positive (+) shaft tilt direction and a shaft tilt direction in which the shaft is tilted to cause a partial contact on a last meshing side of the helical tooth is indicated as a negative (−) shaft tilt direction. In Verification Test 2, as illustrated in FIG. 4A, the positive shaft tilt direction indicates the tilt of the motor shaft 31*a* in which the leading end of the motor shaft 31*a* is tilted in a direction to move away from the driven gear 33. On the other hand, the negative shaft tilt direction indicates the tilt of the motor shaft 31*a* in which the leading end of the motor shaft 31*a* is tilted in a direction to approach the driven gear 33. In Verification Test 2, the rotational unevenness of the driven gear 33 was measured the angle of every 0.5 degree in a range from −1.0 degree to +1.0 degree. As illustrated in FIG. 4A, an encoder 35 was mounted on the gear shaft 33*b* of the driven gear 33 so that the encoder 35 measured the rotational unevenness of the driven gear 33. The graph of FIG. 11 represents the results of the measurement.

Figure 11:
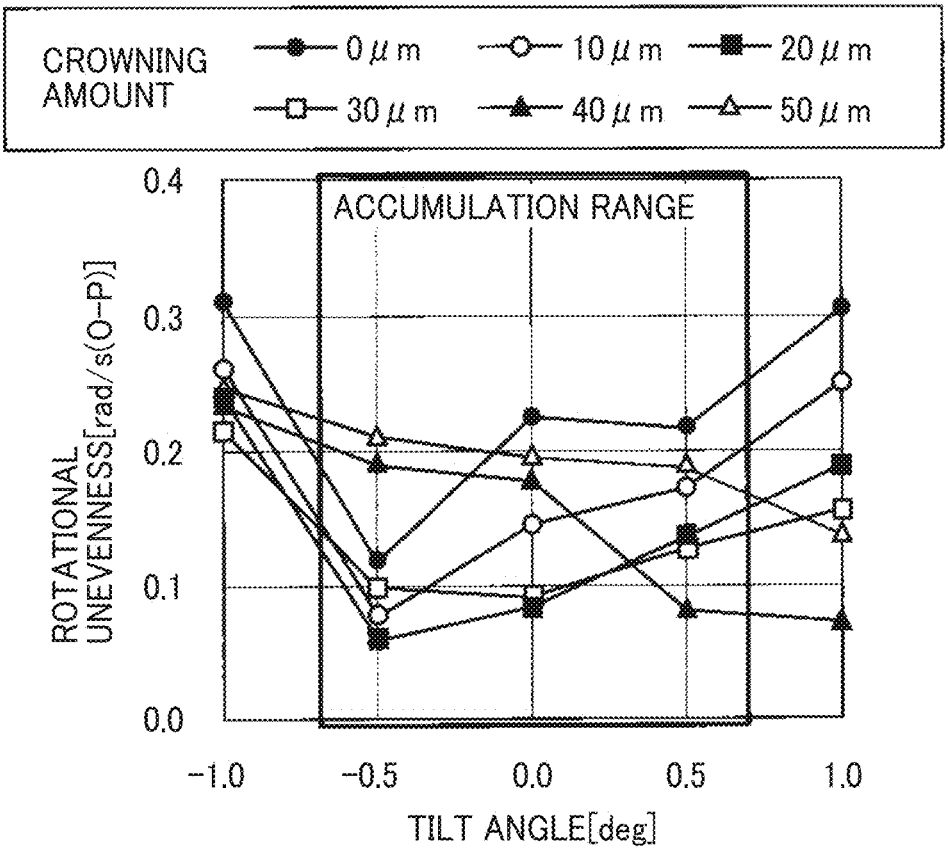
FIG. 11 is a graph of the results of Verification Test 2.

As illustrated in the graph of FIG. 11, the crowned gear having the crowning amount in the range of 10 μm to 30 μm restrained the rotational unevenness, compared with the normal gear (with the crowning amount of 0 μm), in the range of the maximum tilt angle of the motor shaft 31*a* (−0.7 degrees to +0.7 degrees) due to the variation of parts and the accumulation of assembly errors (Accumulation Range). On the other hand, when the tilt angle of the driven gear 33 was −0.5 degrees, the crowned gear having the crowning amount of 40 μm was worse than the normal gear (with the crowning amount of 0 μm) in the rotational unevenness. By contrast, however, when the tilt angle of the driven gear 33 was +0.5 degrees or +1.0 degree, the crowned gear having the crowning amount of 40 μm had the least rotational unevenness and the average value of the rotational unevenness of the crowned gear was sufficiently lower than the normal gear (with the crowning amount of 0 μm). From the above-described results of Verification Test 2, the crowned gear having the crowning amount of 40 μm was also expected to enhance the rotational unevenness of the driven gear 33 sufficiently.

Figure 12A:
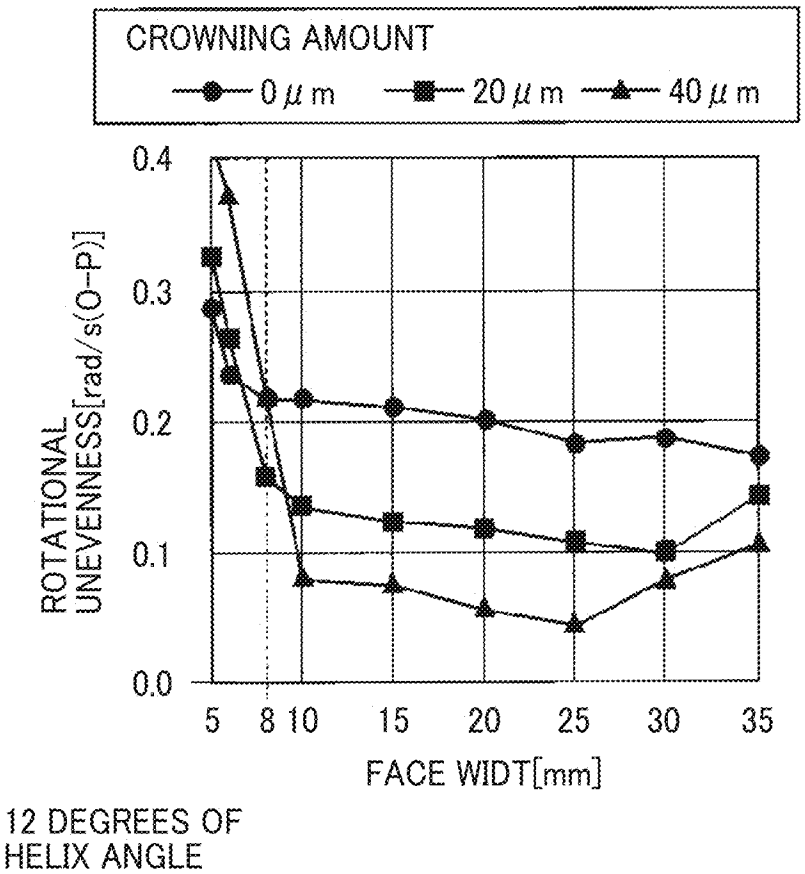
FIGS. 12A and 12B are graphs of the results of tests on the crowning amounts and the face widths of crowned gears.
Figure 12B:
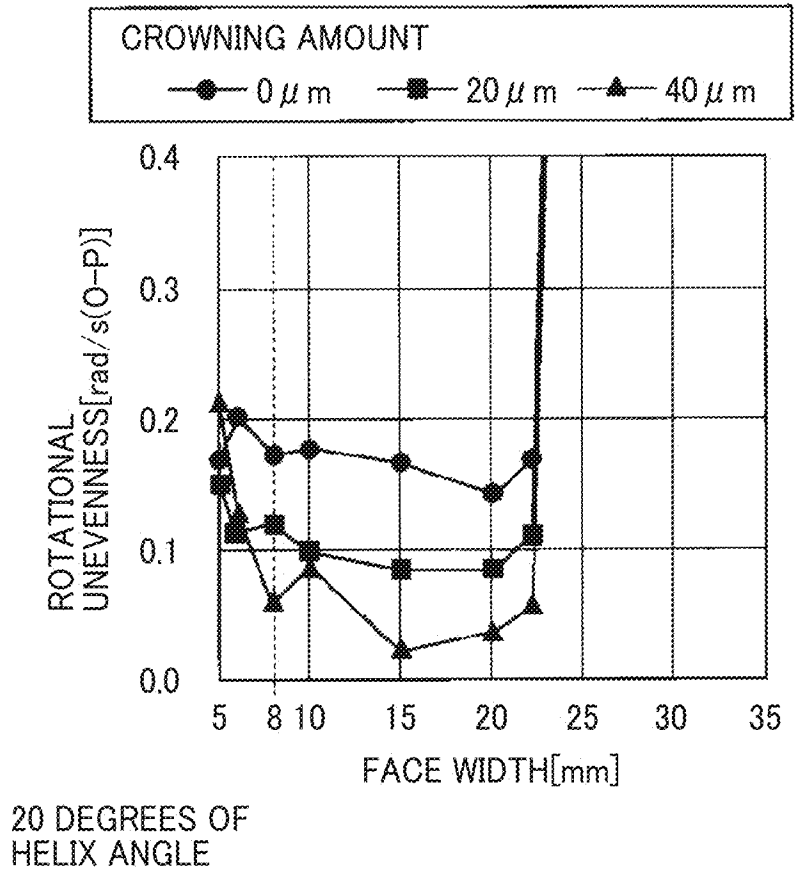

FIGS. 12A and 12B are graphs of the results of the test checking the crowning amount C and the face width W.

Specifically, FIG. 12A is a graph of the results of the test conducted under the condition that the helical tooth has the helix angle α of 12 degrees and FIG. 12B is a graph of the results of the test conducted under the condition that the helical tooth has the helix angle α of 20 degrees.

Note that, in FIGS. 12A and 12B, the motor shaft 31*a* was tilted by +0.5 degrees and the rotational unevenness was measured with the encoder 35 illustrated in FIG. 4A. The gear meshing frequency between the drive gear 32 and the driven gear 33 is 600 Hz to 700 Hz.

As can be seen from FIGS. 12A and 12B, when a crowned gear is used, the face width of the crowned gear is preferably set to 8 mm or greater, which preferably reduces the rotational unevenness equal to or lower than the rotational unevenness of the normal gear (having the crowning amount of 0 μm). Since the crowned gear meshes with another gear in the center of the tooth surface, the contact ratio of the crowned gear is reduced easily when compared with the contact ratio of the normal gear. Further, as the face width W decreases, the curvature (curvature) of the tooth surface with respect to the crowning amount C increases, and therefore the contact ratio tends to decrease easily. Generally, it is known that, when the contact ratio is below 1.2, the gears do not rotate smoothly, which results in an increase in the rotational unevenness and noise. Therefore, when the face width of the crowned gear is below 8 mm, the contact ratio goes below 1.2, which is an insufficient contact ratio to exert a rotational unevenness restraining effect by a crowned gear on the occurrence of misalignment (in other words, an effect to restrain a rotational unevenness of the gear by setting the tooth contact position in the center area in the face width direction). Accordingly, the effect to worsen is greater than the rotational unevenness restraining effect. As a result, the crowned gear is considered to worsen in the rotational unevenness than the normal gear (with the crowning amount of 0 μm). Therefore, when employing a crowned gear, the face width W is set to 8 mm or greater. To be more specific, the face width of the crowned gear as the drive gear 32 or the driven gear 33 is preferably set to be 8 mm or greater. By so doing, the contact ratio remains at 1.2 or greater and the rotational unevenness caused by a decrease in the contact ratio is restrained.

As illustrated in FIG. 12A, when the face width of the tooth of a crowned gear is beyond 30 mm, the rotational unevenness restraining effect by the crowned gear decreases. As the face width W of a crowing gear increases, the curved portion (curvature) of the tooth surface with respect to the crowning amount C decreases. As a result, it is considered that the rotational unevenness restraining effect decreases since the tooth contact position on the occurrence of misalignment is one end side in the face width. Therefore, in order to sufficiently obtain the rotational unevenness restraining effect by the crowned gear, the face width of the crowned gear is preferably set to be 30 mm or smaller. To be more specific, the face width of the crowned gear as the drive gear 32 or the driven gear 33 is preferably set to be 30 mm or smaller.

Note that, as illustrated in FIG. 12B, in a case in which the helix angle $\alpha$ is 20 degrees, when the face width W of the tooth of the crowned gear is greater than 22 mm, the rotational unevenness of the normal gear (with the crowning amount of 0 μm) and the rotational unevenness of the crowned gear increase excessively. Therefore, both the normal gear (with the crowning amount of 0 μm) and the crowned gear cannot be used as the driven gear 33. However, a crowned gear in at least an acceptable range (for example, 8 mm to 22 mm) of the face width restrains the rotational unevenness more effectively than the normal gear (with the crowning amount of 0 μm).

Figure 13:
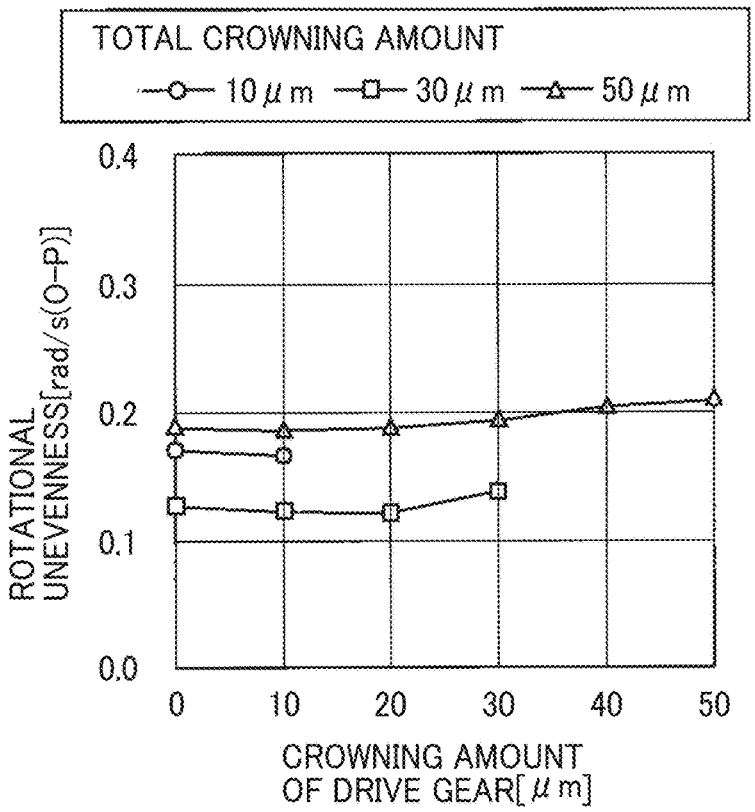
FIG. 13 is a graph of the results of tests conducted under a condition in which the drive gear and the driven gear have various crowning amounts.

FIG. 13 is a graph of the results of tests conducted in a condition in which the drive gear 32 and the driven gear 33 have various crowning amounts.

Note that the graph of FIG. 13 renders the results of the tests conducted under the conditions that the motor shaft 31*a* was tilted by +0.5 degrees and the encoder 35 illustrated in FIG. 4A was used to measure the rotational unevenness. The gear meshing frequency between the drive gear 32 and the driven gear 33 is 600 Hz to 700 Hz.

As illustrated in the graph of FIG. 13, when the crowning amount of the drive gear 32 and the sum of the crowning amounts of the drive gear 32 and the driven gear 33 are identical (in other words, the crowning amount of the drive gear 32 is the same as the total crowning amounts of the drive gear 32 and the driven gear 33), the possible rotational unevenness of the drive gear 32 and the possible rotational unevenness of the driven gear 33 are substantially the same. Therefore, when the total crowning amount of the drive gear 32 and the driven gear 33 are in a range of 10 μm to 40 μm, the rotational unevenness of the drive gear 32 and the rotational unevenness of the driven gear 33 are restrained preferably. In other words, the sum of the crowning amount of the drive gear 32 and the crowning amount of the drive gear 32 and the driven gear 33 is 10 μm or greater and 40 μm or smaller. Note that, considering the processing cost, it is preferable that either the drive gear 32 or the driven gear 33 is a crowned gear.

As described above, a description has been given of the drive device 30 of the fixing device 18 having a heavier load in the image forming apparatus 500, as one embodiment to which this disclosure is applied. However, this disclosure may also be applied to a sheet conveying device in which a transfer sheet is conveyed. By applying this disclosure to the sheet conveying device, noise impact of the image forming apparatus 500 is effectively restrained.

Figure 14:
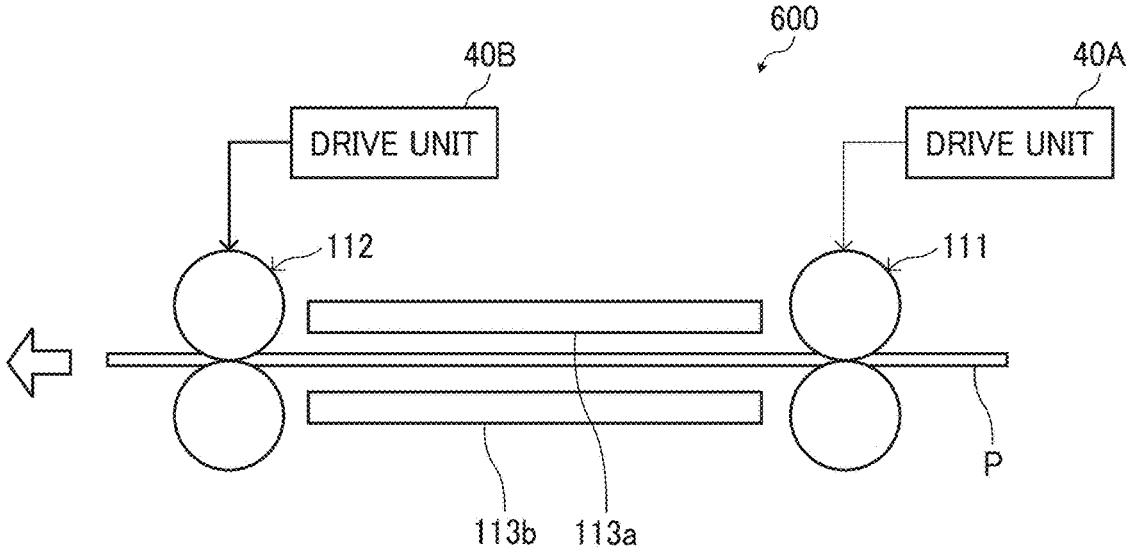
FIG. 14 is a diagram illustrating an example of a schematic configuration of a sheet conveying device.

FIG. 14 is a diagram illustrating an example of a schematic configuration of a sheet conveying device 600.

The sheet conveying device 600 includes a pair of sheet conveying rollers 111, a pair of sheet conveying rollers 112, an upper conveyance guide plate 113*a*, and a lower conveyance guide plate 113*b*. The pair of sheet conveying rollers 112 is disposed downstream from the pair of sheet conveying rollers 111 in the sheet conveyance direction. The upper conveyance guide plate 113*a* and the lower conveyance guide plate 113*b* guide the sheet P conveyed between the pair of sheet conveying rollers 111 and the pair of sheet conveying rollers 112.

As illustrated in FIG. 14, the sheet conveying device 600 includes a drive device 40A configured to drive a pair of sheet conveying rollers 111 and a drive device 40B configured to drive a pair of sheet conveying rollers 112. The drive device 40A and the drive device 40B transmit respective driving forces generated by one drive motor or respective drive motors to the pair of sheet conveying rollers 111 and the pair of sheet conveying rollers 112, respectively, via a plurality of gears. As illustrated in FIG. 14, the sheet conveying device 600 includes a plurality of drive devices, each driving at least a pair of sheet conveying rollers. According to this configuration, the drive devices generate vibration and noise. Since the load on each pair of sheet conveying rollers is relatively light, noise generated in each drive device is relatively small. However, since the image forming apparatus includes a plurality of drive devices, the total amount of noise of the plurality of drive devices contributes to an increase in noise of the whole image forming apparatus.

Therefore, among the plurality of gears of each drive device, a gear that meshes with a metallic drive gear directly mounted on the motor shaft of the drive motor is a crowned gear having the crowning amount less than 50 μm. Accordingly, noise impact of each driving device is restrained, and therefore noise impact of the image forming apparatus is effectively reduced. Further, by setting the total crowning amount of the crowning amount of the drive gear and the crowning amount of the drive gear and the driven gear meshing with the drive gear, to a value in the range of 10 μm to 40 μm, the rotational unevenness of any sheet conveying rollers of the plurality of drive devices in the image forming apparatus is restrained, and therefore the sheet is conveyed stably at a specified speed. In other words, by setting the sum of the crowning amount of the drive gear 32 and the crowning amount of the drive gear 32 and the driven gear 33 to 10 μm or greater and 40 μm or smaller, the sheet is conveyed stably at the specified speed. Accordingly, density unevenness in an image due to a change in the sheet conveying speed is restrained.

Figure 15:
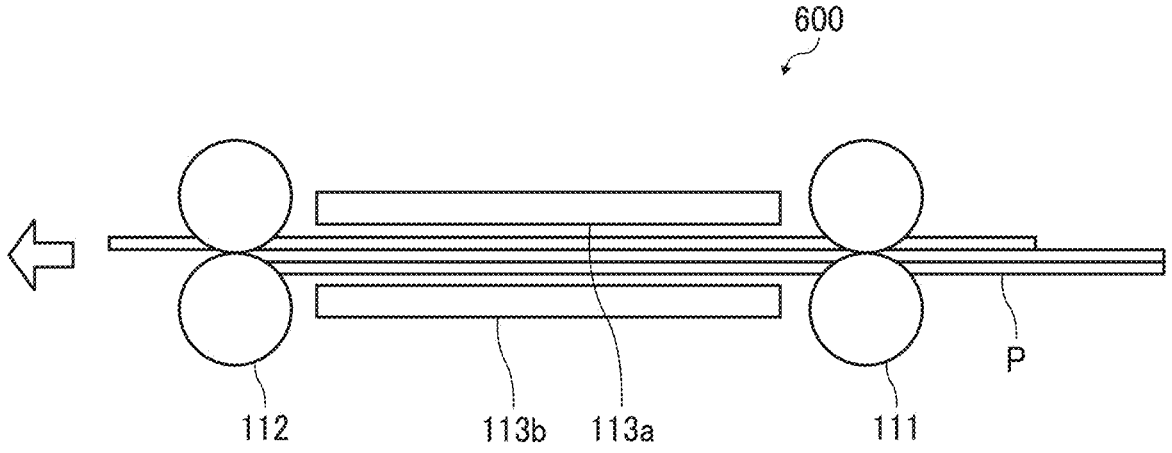
FIG. 15 is a diagram illustrating the sheet conveying device, in a state of a multi-sheet feeding in which a plurality of sheets is conveyed in layers.

FIG. 15 is a diagram illustrating the sheet conveying device 600, in a state of a multi-sheet feeding in which a plurality of sheets is conveyed at a time while being overlapped.

As illustrated in FIG. 15, at the time of a multi-sheet feeding, a load is applied abruptly on the pair of sheet conveying rollers (in FIG. 15, the pair of sheet conveying rollers 111). In this case, there is a risk that the pair of sheet conveying rollers locks to damage or break the gear train. As illustrated in FIGS. 5A and 5C, in a case in which the tooth contact width is small (narrow), the load concentrates on a significantly small area, and therefore the risk of damaging or breaking the gear is relatively high. By contrast, when a crowned gear having the crowning amount less than 50 μm is employed, the tooth contact width is increased, and therefore the risk of damaging or breaking the gear is reduced.

Further, this disclosure is also applicable to a gear train such as a gear train that transmits the driving force to the photoconductor drum 1, a gear train that transmits the driving force to each roller of the developing device 9, a gear train that transmits the driving force to the intermediate transfer belt 5, and a gear train that transmits the driving force to the secondary transfer roller 7. By applying this disclosure to the above-described gear trains, noise is restrained and deterioration in image quality due to vibration and rotational unevenness is restrained.

The configurations according to the above-descried embodiments are not limited thereto. This disclosure can achieve the following aspects effectively.

Aspect 1.

In Aspect 1, an image forming apparatus (for example, the image forming apparatus 500) includes a driven unit (for example, the fixing device 18 and the sheet conveying device 600), and a drive transmitter (for example, the drive device 30 including the gear train) including a drive source (for example, the drive motor 31) configured to drive the driven unit, a drive gear (for example, the drive gear 32) configured to receive a driving force from the drive source, and a driven gear (for example, the driven gear 33) meshed with the drive gear. The drive transmitter is configured to transmit the driving force from the drive source to the driven unit. The drive gear or the driven gear is a crowned gear crowning-processed. The crowned gear has a crowning amount less than 50 μm.

According to this configuration, as described in verification tests (which are Verification Test 1 and Verification Test 2), by setting the drive gear or the driven gear as a crowned gear having the crowning amount less than 50 μm, vibration is more restrained when compared with a configuration in which normal gears having no crowning amount (that is, normal gears with the crowning amount of 0 μm) are meshed with each other, and therefore noise is more reduced.

Aspect 2.

In Aspect 1, the drive gear (for example, the drive gear 32), the driven gear (for example, the driven gear 33), or both is the crowned gear, and a sum of a crowning amount of the drive gear and a crowning amount of the driven gear is 10 μm or greater and 40 μm or smaller.

According to this configuration, as described with reference to FIGS. 11 and 13, the rotational unevenness of the gear or gears is restrained.

Aspect 3.

In Aspect 1 or Aspect 2, a face width of the drive gear (for example, the drive gear 32) or the driven gear (for example, the driven gear 33), that is the crowned gear, is 8 mm or greater.

According to this configuration, as described with reference to FIG. 12, the rotational unevenness of the gear or gears is restrained.

Aspect 4.

In any one of Aspects 1 to 3, a face width of the drive gear (for example, the drive gear 32) or the driven gear (for example, the driven gear 33), that is, the crowned gear, is 30 mm or smaller.

According to this configuration, as described with reference to FIG. 12, the crowned gear provides the rotational unevenness restraining effect of the gear or gears sufficiently.

Aspect 5.

In any of Aspects 1 to 4, the drive gear (for example, the drive gear 32) is mounted on a drive shaft (for example, the motor shaft 31*a*) of the drive source (for example, the drive motor 31).

According to this configuration, as described in the embodiments above, the gear mounted on the drive shaft directly receives the driving force of the drive source. Therefore, unlike other gears, when a load is applied, the gear cannot reduce the load. Therefore, the greatest load is applied to the meshing portion at which the gear mounted on the drive shaft and the driven gear mesh with each other. Therefore, by setting the gear mounted on the drive shaft or the gear meshed with the gear mounted on the drive shaft to be a crowned gear having the crowning amount less than 50 μm, vibration and noise in misalignment are effectively restrained.

Aspect 6.

In any one of Aspects 1 to 5, the drive gear (for example, the drive gear 32) is made of metal and the driven gear (for example, the driven gear 33) is made of resin.

According to this configuration, as described in the embodiments above, different from a resin gear, a hard metal drive gear does not deform elastically and therefore has a low effect of attenuating vibration. For this reason, vibration and noise are likely to increase at the meshing portion at which the gear meshes with the metal gear. Therefore, by employing a metal gear or a resin gear that meshes with the metal gear as a crowned gear having the crowning amount less than 50 μm, vibration and noise in misalignment are effectively restrained.

Aspect 7.

In any one of Aspects 1 to 6, the driven gear (for example, the driven gear 33) is the crowned gear.

According to this configuration, vibration and noise at the meshing portion of the drive gear (for example, the drive gear 32) and the driven gear are restrained.

Aspect 8.

In any one of Aspects 1 to 7, the drive gear (for example, the drive gear 32) is the crowned gear.

According to this configuration, vibration and noise at the meshing portion of the drive gear and the driven gear (for example, the driven gear 33) are restrained.

Aspect 9.

In any one of Aspects 1 to 8, wherein the driven unit (for example, the fixing device 18 and the sheet conveying device 600) is a fixing device (for example, the fixing device 18).

According to this configuration, as described in the embodiments above, the gear of the drive transmitter to transmit the driving force of the drive source (for example, the drive motor 31) to the fixing device having a heavier load in the image forming apparatus is a crowned gear having the crowning amount less than 50 μm. By doing so, the noise of the image forming apparatus is restrained effectively.

Aspect 10.

In any of the first to ninth aspects, the driven unit (for example, the fixing device 18, the sheet conveying device 600) is a sheet conveying device (for example, the sheet conveying device 600).

According to this configuration, as described in the embodiments above, the sheet conveying device includes a plurality of drive devices, and therefore noise is generated in each of the plurality of driving devices. Therefore, the total amount of noise of the plurality of drive devices contributes to an increase in noise of the whole image forming apparatus. Therefore, the gear of the drive transmitter that conveys the driving force of the drive source to each pair of sheet conveying rollers in the sheet conveying device is a crowned gear having the crowning amount of less than 50 μm. By so doing, noise of each driving device is restrained, and therefore noise of the image forming apparatus is effectively reduced. Further, when a sudden change in load occurs due to the occurrence of multi-sheet feeding, this configuration prevents the gear or gears from damage or breakage.

In the above-described embodiments, the sheet P for image formation is employed as a recording medium on which an image is formed. However, the sheet P is not limited to the recording medium but also includes thick paper, postcard, envelope, plain paper, thin paper, coated paper, art paper, tracing paper, and the like. The sheet P further includes a non-paper material such as OHP sheet, OHP film, resin film, and any other sheet-shaped material on which an image may be formed.

The effects described in the embodiments of this disclosure are listed as the examples of preferable effects derived from this disclosure, and therefore are not intended to limit to the embodiments of this disclosure.

The embodiments described above are presented as examples to implement this disclosure and are not intended to limit the scope of this disclosure. These novel embodiments can be implemented in various other forms, and various omissions, replacements, or changes can be made without departing from the gist of this disclosure. These embodiments and their variations are included in the scope and gist of this disclosure, and are included in the scope of this disclosure recited in the claims and its equivalent.

Any one of the above-described operations may be performed in various other ways, for example, in an order different from the one described above.

What is claimed is:

1. An image forming apparatus comprising:
a driven unit; and
a drive transmitter including
a drive source configured to drive the driven unit;
a drive gear configured to receive a driving force from the drive source; and
a driven gear meshed with the drive gear,
the drive transmitter being configured to transmit the driving force from the drive source to the driven unit,
the drive gear or the driven gear being a crowned gear crowning-processed, the crowned gear having a crowning amount less than 50 μm,
wherein the drive gear, the driven gear, or both is the crowned gear, and
wherein a sum of a crowning amount of the drive gear and a crowning amount of the driven gear is 10 μm or greater and 40 μm or smaller.

2. The image forming apparatus according to claim 1, wherein a face width of the crowned gear is 8 mm or greater.

3. The image forming apparatus according to claim 1, wherein a face width of the crowned gear is 30 mm or smaller.

4. The image forming apparatus according to claim 1, wherein the drive gear is mounted on a drive shaft of the drive source.

5. The image forming apparatus according to claim 1, wherein the drive gear is made of metal and the driven gear is made of resin.

6. The image forming apparatus according to claim 1, wherein the driven gear is the crowned gear.

7. The image forming apparatus according to claim 1, wherein the drive gear is the crowned gear.

8. The image forming apparatus according to claim 1, wherein the driven unit is a fixing device.

9. The image forming apparatus according to claim 1, wherein the driven unit is a sheet conveying device.

10. An image forming apparatus comprising:
a driven unit; and
a drive transmitter including
a drive source configured to drive the driven unit;
a drive gear configured to receive a driving force from the drive source; and
a driven gear meshed with the drive gear,
the drive transmitter being configured to transmit the driving force from the drive source to the driven unit,
the drive gear or the driven gear being a crowned gear crowning-processed, the crowned gear having a crowning amount less than 50 μm,
wherein a face width of the crowned gear is 8 mm or greater.

11. The image forming apparatus according to claim 10, wherein the drive gear is mounted on a drive shaft of the drive source.

12. The image forming apparatus according to claim 10, wherein the drive gear is made of metal and the driven gear is made of resin.

13. The image forming apparatus according to claim 10, wherein the driven gear is the crowned gear.

14. The image forming apparatus according to claim 10, wherein the drive gear is the crowned gear.

15. An image forming apparatus comprising:
a driven unit; and
a drive transmitter including
a drive source configured to drive the driven unit;
a drive gear configured to receive a driving force from the drive source; and
a driven gear meshed with the drive gear,
the drive transmitter being configured to transmit the driving force from the drive source to the driven unit,
the drive gear or the driven gear being a crowned gear crowning-processed, the crowned gear having a crowning amount less than 50 μm,
wherein a face width of the crowned gear is 30 mm or smaller.

16. The image forming apparatus according to claim 15, wherein the drive gear is mounted on a drive shaft of the drive source.

17. The image forming apparatus according to claim 15, wherein the drive gear is made of metal and the driven gear is made of resin.

18. The image forming apparatus according to claim 15, wherein the driven gear is the crowned gear.

19. The image forming apparatus according to claim 15, wherein the drive gear is the crowned gear.

* * * * *